United States Patent [19]

Wood

[11] Patent Number: 4,838,479

[45] Date of Patent: Jun. 13, 1989

[54] HEAVY DUTY CARRYING HANDLE FOR A CAN CARTON

[75] Inventor: Prentice J. Wood, Hapeville, Ga.

[73] Assignee: The Mead Corporation, Dayton, Ohio

[21] Appl. No.: 249,115

[22] Filed: Sep. 26, 1988

[51] Int. Cl.[4] ..... B65D 5/46

[52] U.S. Cl. ..... 229/52 B; 206/141; 206/427

[58] Field of Search ..... 229/40, 52 B; 206/141, 206/427, 434

[56] References Cited

U.S. PATENT DOCUMENTS

| | | | |
|---|---|---|---|
| 2,465,324 | 3/1949 | De Mian | 229/52 B |
| 2,851,210 | 9/1958 | Kramer et al. | 206/141 |
| 3,809,310 | 5/1974 | Vanderlugt, Jr. | 229/52 B |
| 4,364,509 | 12/1982 | Holley, Jr. et al. | 229/52 B |
| 4,588,084 | 5/1986 | Holley, Jr. | 206/427 |
| 4,679,726 | 7/1987 | Oliff | 206/427 |
| 4,681,252 | 7/1987 | Doerr et al. | 229/52 B |

*Primary Examiner*—Gary Elkins

*Attorney, Agent, or Firm*—Rodgers & Rodgers

[57] ABSTRACT

A heavy duty carrying handle for a can carton formed from a unitary blank and which includes interconnected bottom, top and side walls together with end closure structure and wherein the top wall is of double ply construction having inner and outer panels, the handle having a transverse elongated opening formed in the inner panel and having spaced apart side edges, a pair of transverse fold lines formed in the outer panel in near coincidence with the side edges of the transverse elongated opening, a pair of transverse handle flaps struck from the outer panel and respectively joined thereto along the transverse fold lines, the transverse handle flaps having coincidental transverse edges defined by a transverse perforated slit along which the handle flaps are separable to accommodate inward folding of the handle flaps through the transverse elongated opening.

8 Claims, 2 Drawing Sheets

HEAVY DUTY CARRYING HANDLE FOR A CAN CARTON

TECHNICAL FIELD

This invention relates generally to can cartons and more particularly to heavy duty carrying handles for such cartons.

BACKGROUND ART

U.S. Pat. No. 4,558,816 issued Dec. 17, 1985 and owned by the assignee of this invention discloses a can carton in which a pair of handle panels are struck from one carton wall and whose adjacent edges are coincidental with a transverse perforated slit extending across the one carton wall and having end projections extending into the carton walls foldably joined with the one carton wall.

DISCLOSURE OF THE INVENTION

According to this invention in one form, a heavy duty carrying handle is provided for a can carton which is formed from a unitary blank and which includes interconnected bottom, side and top walls together with end closure panels, the top wall being of a double ply construction and the handle comprising a transverse elongated opening formed in the inner panel and having spaced apart side edges, a pair of transverse fold lines formed in the outer panel in near coincidence with the side edges of said transverse elongated opening, a pair of transverse handle flaps struck from said outer panel and respectively joined thereto along said transverse fold lines, said transverse handle flaps having coincidental transverse edges defined by a transverse perforated slit along which said handle flaps are separable to accommodate inward folding of said handle flaps through said transverse elongated opening.

BEST MODE OF CARRYING OUT THE INVENTION

Figure 2:
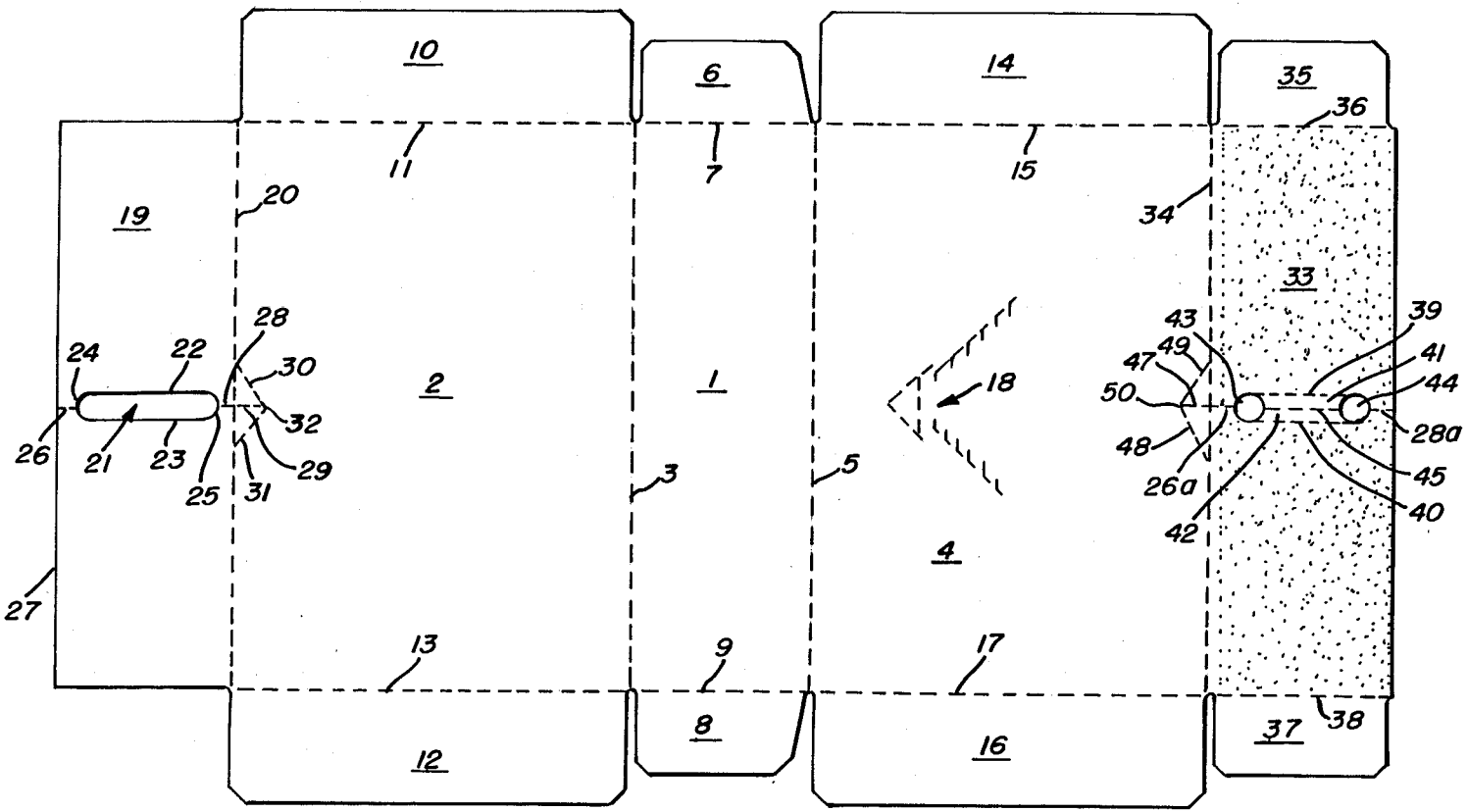
FIG. 2 is a plan view of the blank from which the carton of FIG. 1 is formed, the blank being shown with its inner surface up.

With reference to FIG. 2 the numeral 1 designates the bottom wall of the carton. Side wall 2 is foldably joined to bottom wall 1 along fold line 3 and side wall 4 is foldably joined to bottom wall 1 along fold line 5.

An end flap 6 is foldably joined to bottom wall 1 along a fold line 7 and an end flap 8 is foldably joined to bottom wall 1 along fold line 9. End wall panel 10 is foldably joined to side wall 2 along a fold line 11 and end wall panel 12 is foldably joined to side wall 2 along fold line 13. End wall panel 14 is foldably joined to side wall 4 along fold line 15 and end panel 16 is foldably joined to side wall 4 along fold line 17.

Known frangible tear structure is formed in side wall 4 as is indicated by the arrow 18.

In accordance with this invention, the top wall of the carton is of double ply structure and includes inner panel 19 which is foldably joined to side wall 2 along fold line 20. A transverse elongated opening is designated by the arrow 21 and includes transverse spaced side edges 22 and 23. End edges of transverse elongated opening 21 are designated at 24 and 25 and are of semicircular configuration. A perforated slit 26 extends from end 24 of transverse elongated opening 21 to the side edge 27 of inner panel 19. Similarly a transverse perforated slit 28 extends from end portion 25 of transverse elongated opening 21 to the side edge 20 of inner panel 19. A slit extension 29 is formed in side wall 2. Fold lines 30 and 31 extend from the end 32 of slit extension 29 to the fold line 20 between side wall 2 and inner top wall panel 19.

Outer top wall panel 33 is foldably joined to side wall 4 along fold line 34. An end flap 35 is foldably joined to outer top wall panel 33 along fold line 36 and end flap 37 is foldably joined along fold line 38 to the opposite end of outer top wall panel 33.

Also formed in outer panel 33 are a pair of transverse fold lines 39 and 40. A transverse handle flap 41 is foldably joined to outer panel 33 along fold line 39 and transverse handle flap 42 is foldably joined to outer panel 33 along fold line 40. A pair of apertures 43 and 44 are formed in outer panel 33 and preferably are of circular configuration. These apertures 43 and 44 define the end edges of handle flaps 41 and 42 as is obvious from FIG. 2. A transverse perforated slit 45 defines coincidental edges of handle flaps 41 and 42. Inward folding of one or both handle flaps causes separation of the coincidental edges of handle flaps 41 and 42 to accommodate inward folding of the handle flaps. A transverse perforated slit 26*a* is formed in outer panel 33 and is coaxially disposed relative to transverse perforated slit 45. Similarly perforated transverse slit 28*a* is formed in outer panel 33 and is coaxially disposed relative to transverse perforated slit 45. Formed in side wall 4 is an extension 47 of perforated slit 26*a*. A pair of fold lines 48 and 49 extend from the extremity 50 of extension 47 in angular relation to the fold line 34.

In order to complete manufacture of the carton by the carton manufacturer, an application of glue is applied to the inner surface of outer top wall panel 33 as indicated in FIG. 2 by stippling on that panel. Thereafter side wall panel 2 together with inner top wall panel 19 are elevated and folded toward the right along fold line 3. Outer top wall panel 33 is then elevated and folded to the left along fold line 34. This operation secures inner panel 19 and outer panel 33 in face contacting relation to form a double thickness top wall for the carton. This operation establishes coincidental fold lines by bringing the perforated transverse slit 26 into coincidence with the perforated transverse slit 26*a* and also causes the transverse perforated slit 28 to come into coincidence with the transverse perforated slit 28*a*. These coincidental slits are coaxially disposed relative to the perforated transverse slit 45 formed in outer top panel 33.

Figure 3:
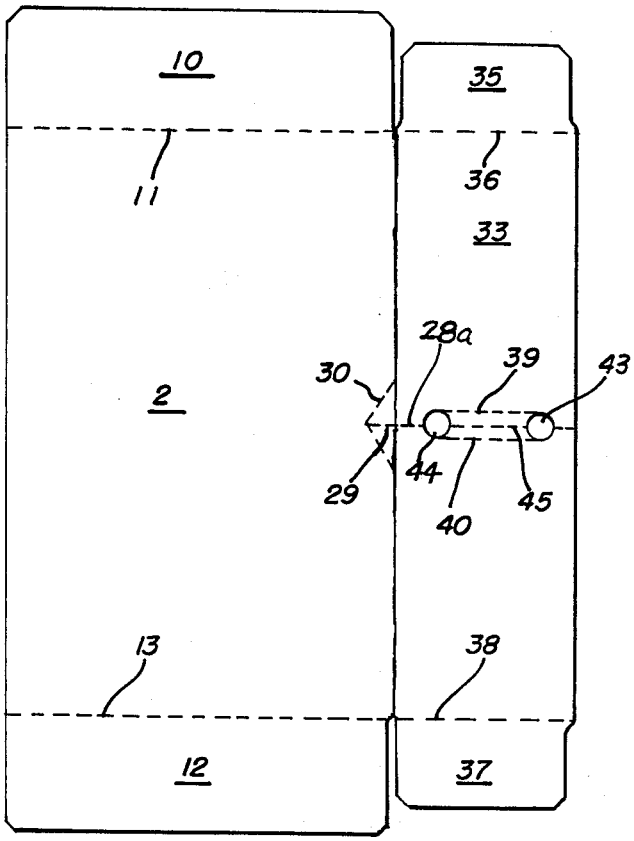
FIG. 3 is a view of the blank shown in FIG. 2 following its initial gluing operation as performed by the carton manufacturer.

The carton as shown in FIG. 3 is then shipped by the carton manufacturer to the packager of cans who simply sets up the carton with its ends open through which cans are loaded from both ends. Thereafter the end panels such as 10, 12, 14 and 16 and the end flaps such as 6, 8, 35 and 37 are manipulated into end closing positions and secured in such positions by adhesive in known manner so that the carton when fully loaded appears as shown in FIG. 1.

Figure 1:
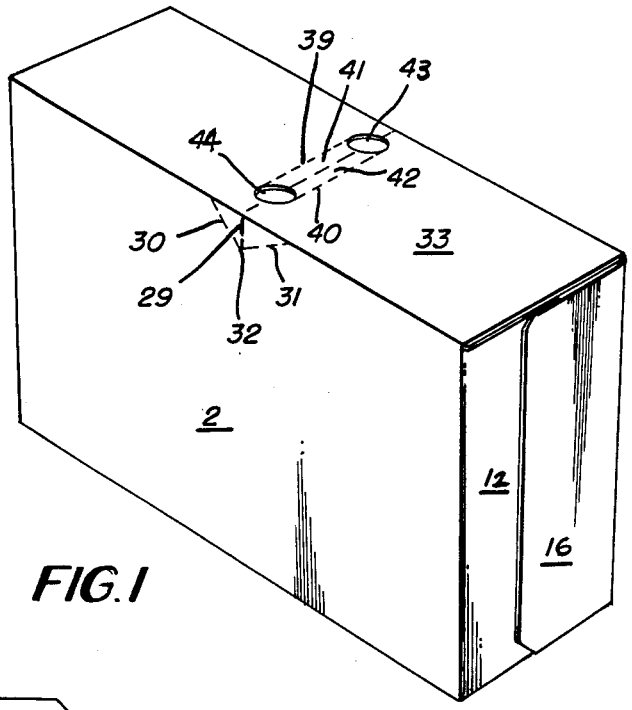
FIG. 1 is a perspective view of a loaded set up can carton which embodies the heavy duty handle structure of this invention.

In order to transport the carton shown in FIG. 1, it is simply necessary to depress the handle flaps 41, 42 and to fold those flaps inwardly.

Figure 4:
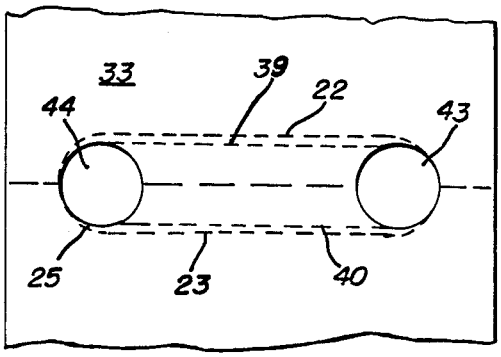
FIG. 4 is a fragmentary plan view of a portion of the top wall of the carton and which shows a preferred relationship between the handle structure formed in the outer and inner plys of the top wall.

While the ends such as 24 and 25 of the elongated opening 21 are in near coincidence with the adjacent portions of apertures 43 and 44, the fold lines 39 and 40 may be in near coincidence with the side edges 22 and 23 of elongated transverse opening 21, although it is preferable to space these elements, as shown in FIG. 4, i.e., with transverse fold lines 39 and 40 spaced inwardly somewhat from the side edges 22 and 23 of elongated transverse opening 21.

INDUSTRIAL APPLICABILITY

From the above description, it is apparent that a heavy duty handle structure is provided for a can carton which is particularly well suited for heavy carton loads. For example filled 12 ounce cans can be well accommodated by a carton with the heavy duty handle structure of this invention where as many as 30 or more primary can packages are disposed within the can carton.

I claim:

1. A carrying handle for a carton formed from a unitary blank for packaging a plurality of cans and having interconnected single ply bottom and side walls and a double ply top wall having inner and outer panels together with end closure panels, said handle comprising a transverse elongated opening formed in said inner panel and having spaced apart side edges, a pair of transverse fold lines formed in said outer panel in near coincidence with said side edges of said transverse elongated opening, a pair of transverse handle flaps struck from said outer panel and respectively joined thereto along said transverse fold lines, said transverse handle flaps having coincidental transverse edges defined by a transverse perforated slit along which said handle flaps are separable to accommodate inward folding of said handle flaps through said transverse elongated opening.

2. A carrying handle according to claim 1 wherein each end edge of each of said handle flaps is defined by a part of an aperture formed in said outer panel.

3. A carrying handle according to claim 2 wherein each of said apertures is of circular configuration.

4. A carrying handle according to claim 3 wherein each end portion of said transverse elongated opening is of semi circular configuration and disposed in near coincidence with the adjacent one of said circular apertures.

5. A carrying handle according to claim 1 wherein said side edges of said elongated opening are spaced apart by a distance slightly greater than the distance between said transverse fold lines.

6. A carrying handle according to claim 1 wherein coincidental perforated slits are formed in said outer and said inner panels adjacent and normal to the side edges of said top wall and arranged in substantially coaxial relation to said transverse perforated slit.

7. A carrying handle according to claim 6 wherein each of said coincidental perforated slits includes an extension which is continued into the associated single ply side wall.

8. A carrying handle according to claim 7 wherein a pair of fold lines are formed in each of said side walls and extend from the extremity of each of said extensions to the adjacent carton corner between said top wall and the associated side wall.

* * * * *